US005092477A

United States Patent [19]

Johnson, Jr. et al.

[11] Patent Number: 5,092,477

[45] Date of Patent: Mar. 3, 1992

[54] CONTAINER CLOSURE

[76] Inventors: John C. Johnson, Jr., 202 Crest Dr., Paramus, N.J. 07652; David Werdermann, 14 Lozrovich Pl., West Paterson, N.J. 07424

[21] Appl. No.: 715,793

[22] Filed: Jun. 14, 1991

[51] Int. Cl.[5] ..... B65D 55/02; B65D 51/18

[52] U.S. Cl. ..... 215/230; 215/220; 215/341

[58] Field of Search ..... 215/230, 203, 204, 208, 215/218, 219, 220, 221, 222, 334, 341, 349, 350

[56] References Cited

U.S. PATENT DOCUMENTS

| | | | |
|---|---|---|---|
| 2,131,774 | 10/1938 | Waring | 215/341 X |
| 2,226,390 | 12/1940 | Rosevear, Jr. | 215/221 X |
| 2,597,307 | 5/1952 | Elkind | 215/220 |
| 3,073,468 | 1/1963 | Arneson | 215/230 |
| 3,977,554 | 8/1976 | Costa | 215/220 |
| 4,069,935 | 1/1978 | Hampel | 215/203 |
| 4,588,098 | 5/1986 | Uzdy | 215/230 |
| 4,605,135 | 8/1986 | Ryder | 215/220 |
| 4,723,673 | 2/1988 | Tartaglia et al. | 215/230 |
| 4,747,497 | 5/1988 | Holman | 215/230 |
| 4,984,700 | 1/1991 | Knickerbocker | 215/251 |

*Primary Examiner*—Stephen Marcus
*Assistant Examiner*—Vanessa Caretto
*Attorney, Agent, or Firm*—W. Patrick Quast

[57] ABSTRACT

A closure for a container for use in resisting child opening thereof and for recording an act of tampering therewith. This closure has an outer cap and a liner and an inner cap coaxially disposed along a common axis. The inner cap has an outer surface with peripheral groove portions and axial groove portions. The outer cap has an inner surface with a pair of radially protruding spikes which are received and travel in the groove portions for resisting child opening thereof. The liner has a shearable, indicia-marked top foil and a top adhesive attached to the interior surface of a top transparent end wall of the outer cap, and has a bottom, indicia-marked foil with a bottom adhesive attached to the exterior surface of a top end wall of the inner cap, and has an adhesive strip disposed between the two foils, for recording an act of tampering therewith.

8 Claims, 7 Drawing Sheets

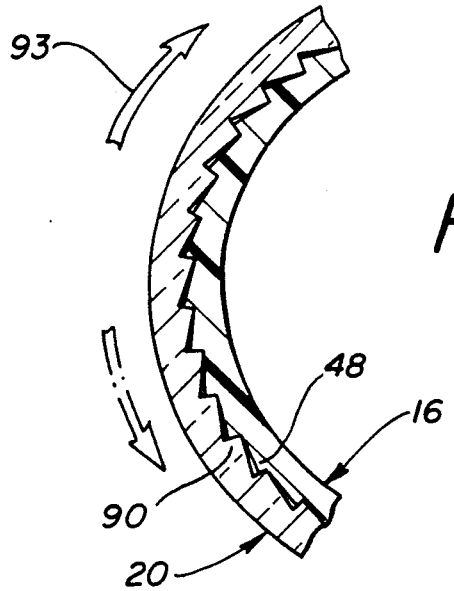
FIG-6
FIG-7
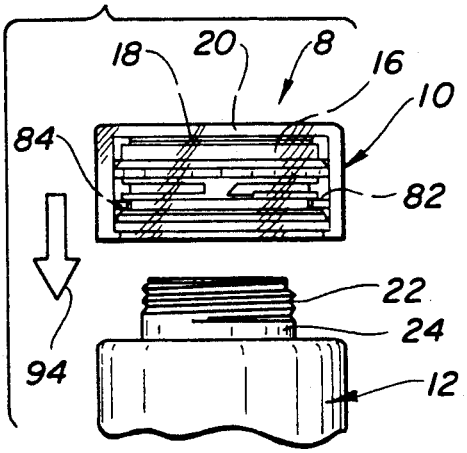
FIG-8
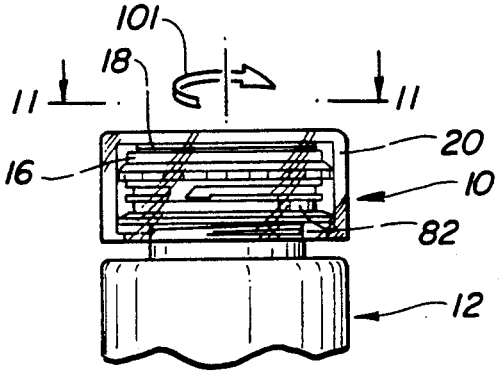
FIG-9
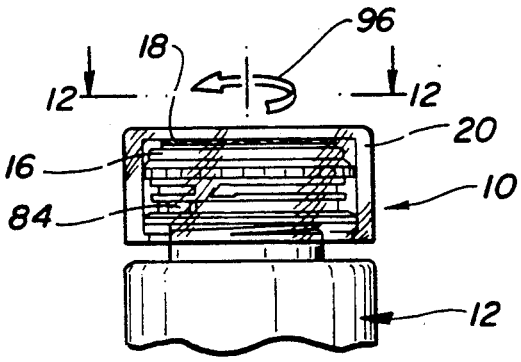
FIG-10
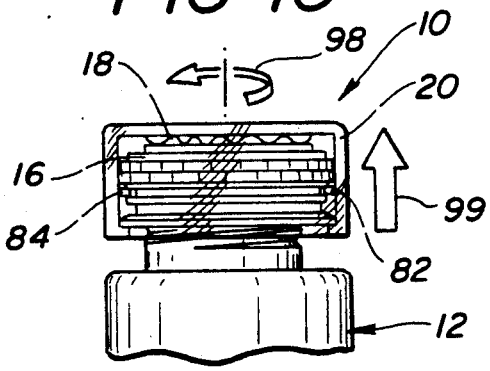

CONTAINER CLOSURE

This invention relates to a container closure, and in particular, the invention relates to a dual-cap container closure having an outer cap having at least a transparent end wall and a tamper sensing, multiple-layer liner and having an inner cap with outer interconnect grooves and inner container threads.

BACKGROUND OF THE INVENTION

The prior art container includes a single cap which includes a tamper evident seal. In this prior art application, the seal is a four-part laminate. The laminate comprises a low density polyethylene (LDPE), adhesive film layer bonded to aluminum foil, which is wax-bonded to a white-lined pulpboard. The foil is gravure-printed with cautionary words, such as, "sealed". In the assembly process, the laminate is placed in the cap, which is then screwed on the bottle. The pulpboard is positioned up. Using an induction sealing process, an electromagnetic field is focused on the bottle rim, creating heat in the foil/adhesive portion of the seal. This melts the LDPE layer, fusing the aluminum foil inner seal to the bottle. The heat field also melts the wax layer, releasing the pulpboard liner from the foil so the liner remains in the cap or closure.

One problem with the prior art closure and seal system is that there is no visible evidence of tampering until the user actually opens the bottle. Further, the residue of the foil inner seal, after it has been broken, impedes a tight reclosure. Also, portions of the foil inner seal can drop into the container, thus possibly contaminating the product therein. Further, the prior art design does not disclose a combination system which is child resistant as well as providing visual evidence of tampering before purchase.

SUMMARY OF THE INVENTION

According to the present invention, a tamper indicating and child resisting closure is provided. This closure comprises an outer cap having at least a transparent end wall with a tamper-sensing liner and having an annular wall with inner spikes and comprises a coaxial inner cap having a peripheral wall with outer spike-receiving peripheral and axial groove portions and with inner container-engaging threads.

By using an outer cap transparent end wall with a tamper-sensing liner, a way to sense and record tampering, without removing the cap is provided. By using inner cap spike-receiving peripheral and axial groove portions, a way is provided to resist a child opening the closure.

The foregoing and other objects, features and advantages will be apparent from the following description of the preferred embodiments of the invention as illustrated in the accompanying drawings.

BRIEF DESCRIPTION OF THE DRAWINGS

FIG. 6 is a section view as taken along line 6-6 of FIG. 5;

FIG. 7 is an elevation view of the assembled container closure of FIG. 2 during the step of connecting the closure to a container;

FIG. 8 is an elevation view of the closure of FIG. 7 during the next step of connecting the closure to the container;

FIG. 9 is an elevation view of the closure of FIG. 8 depicting an attempt to remove the closure from the container which will result in an indication of tampering without removal of the closure;

FIG. 10 is an elevation view of the closure of FIG. 9 depicting the proper step of removing the closure from the container;

DESCRIPTION OF THE PREFERRED EMBODIMENTS

Figure 1:
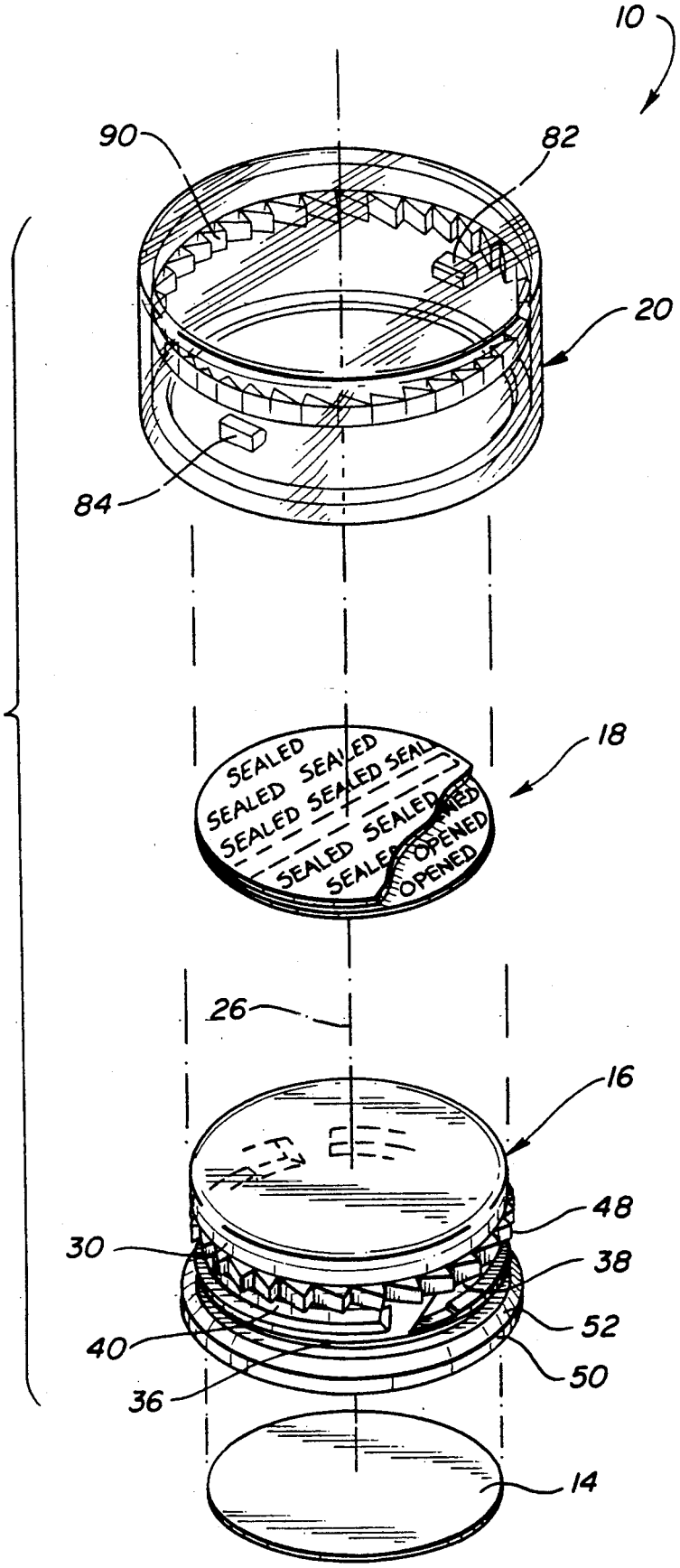
FIG. 1 is a perspective view of a container closure according to the present invention.
Figure 2:
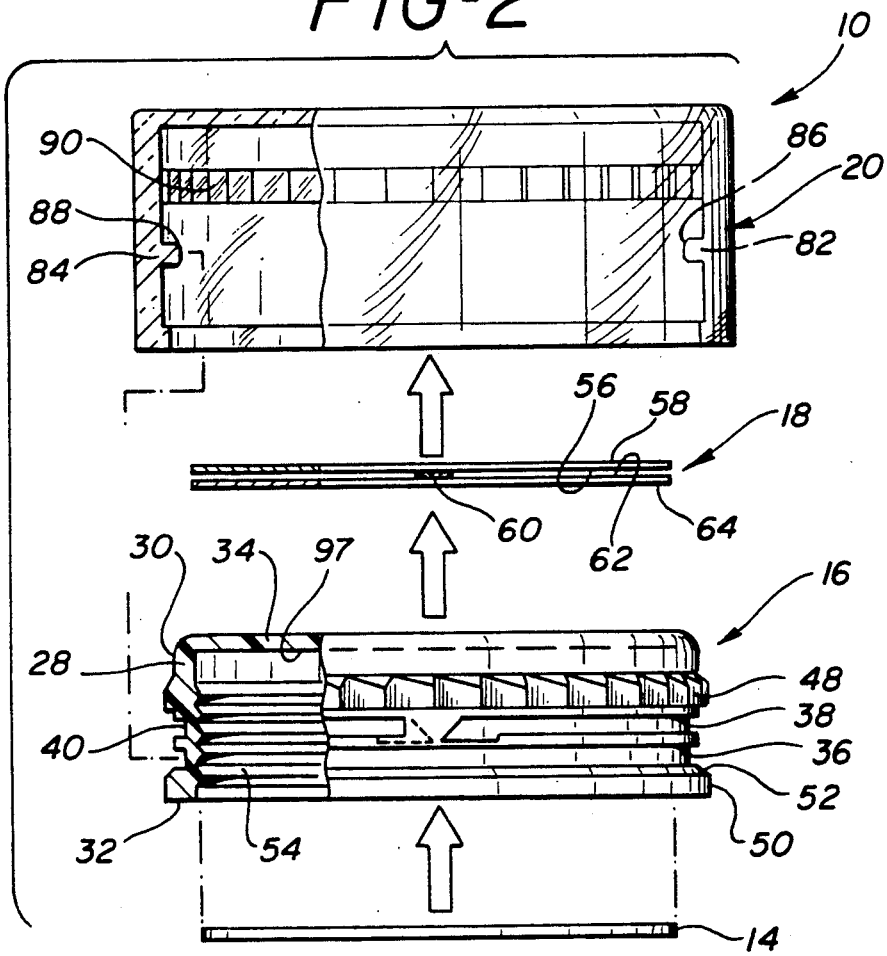
FIG. 2 is an exploded elevation view of the container closure of FIG. 1.
Figure 3:
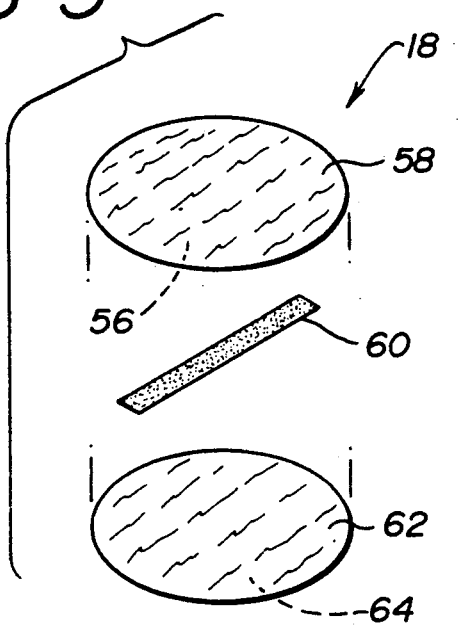
FIG. 3 is a perspective view of a liner portion of FIG. 1.

As shown in FIGS. 1, 2 and 7, an assembly 8 is provided. Assembly 8 includes a composite or closure 10 and a bottle or container 12. Closure 10 includes an inner cap 16, a tamper sensing liner 18, and an outer cap 20. Outer cap 20 is made of a transparent plastic material. Inner cap 16 is also made of a plastic material.

As shown in FIG. 7, container 12 has a spout portion 22 which has an outer thread 24.

As shown in FIGS. 1, 2, 5, 7, and 13, inner cap 16 has an axis 26 and has a peripheral wall 28, which has a radially outer surface 30. Inner cap 16 also has a bottom circular axial end edge 32 and has a top end wall 34. At the customer's option, inner cap 16 may include a secondary liner 14. Secondary liner 14 is typically made from pulpboard, plastic or other material. It is secured to top end wall 34 by a touch of glue, or press fit into the inner cap so as to be retained therein. Alternately, the end user can secure the secondary liner member to the bottle opening.

Figure 5:
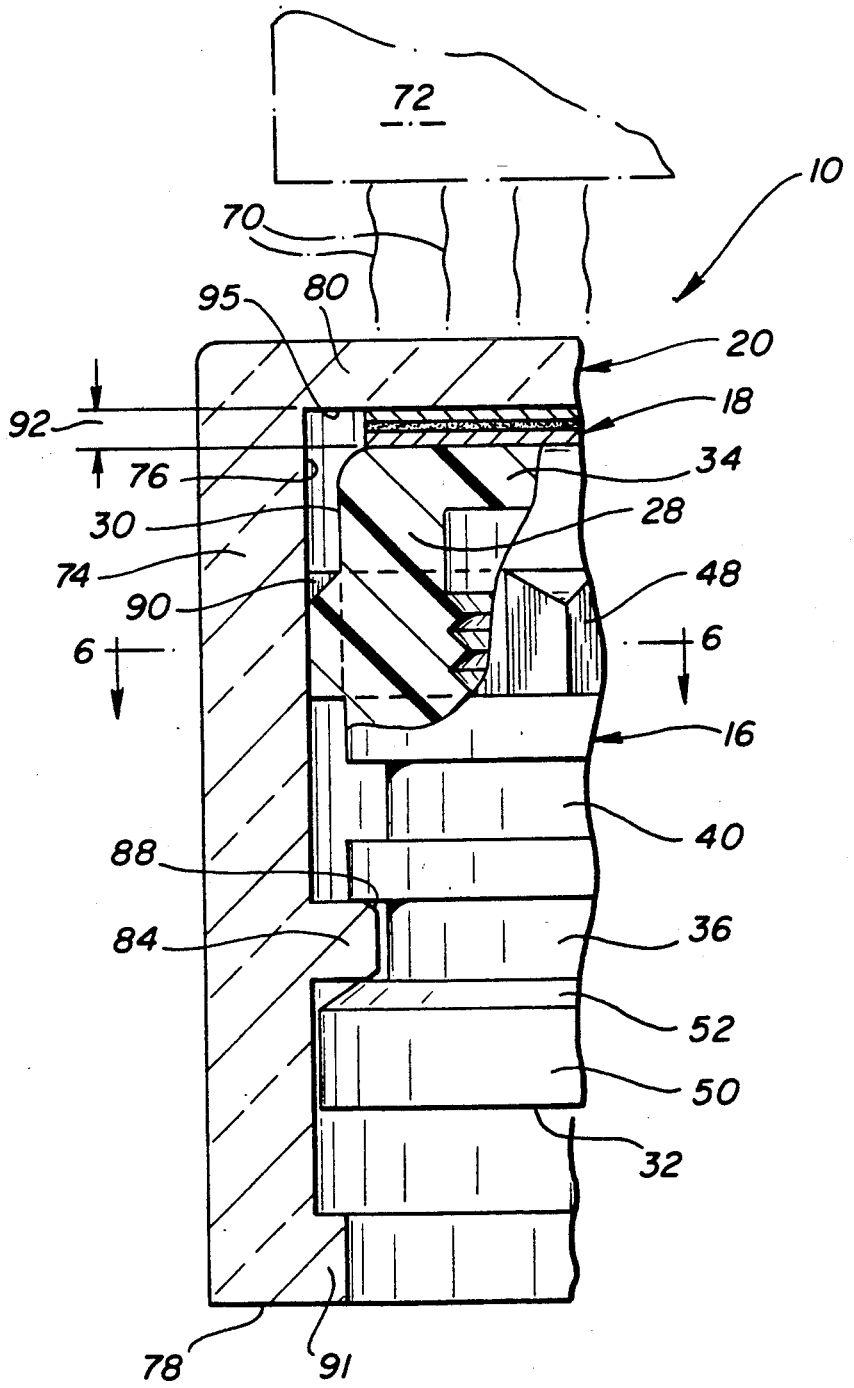
FIG. 5 is a section view through the assembled container closure of FIG. 2.

As shown in FIGS. 2 and 5, outer surface 30 has a bottom circular 360 degree groove or channel 36, and has a first semi-circular 170 degree top groove or channel 38, and has a second semi-circular 170 degree top groove or channel 40.

Figure 13:
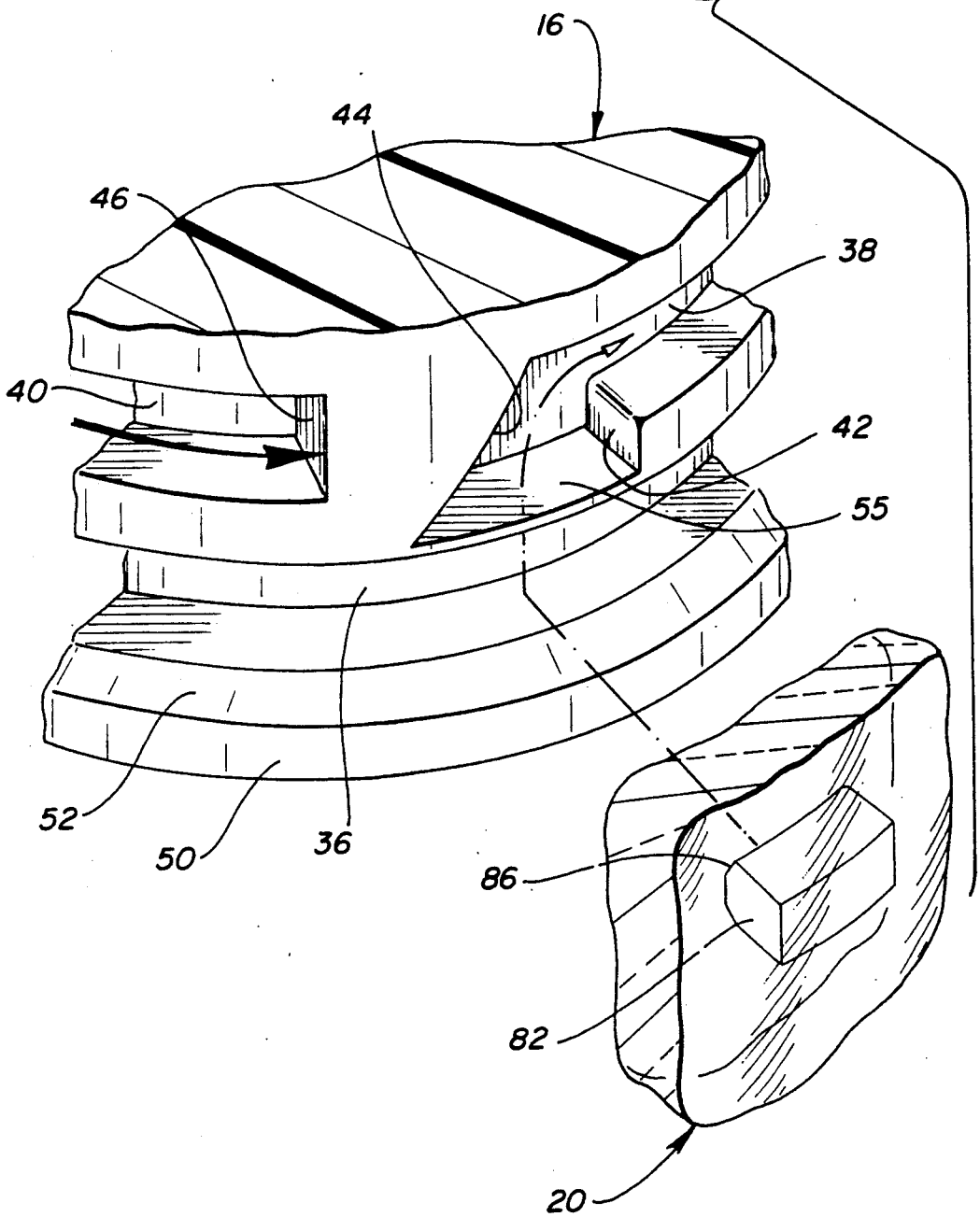
FIG. 13 is an exploded perspective view of a small portion of the closure of FIG. 7.

As shown in FIGS. 2 and 13, each 170 degree channel 38, 40 has a vertical or axial groove or channel 42, which has a sidewall cam surface 44; and has a stop wall 46. Outer surface 30 also has a circular series of ratchet teeth 48, which is disposed above top channel 38. Outer surface 30 also has a ridge portion 50, which is disposed below bottom channel 36. Ridge 50 has a chamfer or chamferred edge 52, for ease of assembling inner cap 16 into outer cap 20. Inner cap 16 also has an internal thread 54, which connects to thread 22. Vertical groove 42 also has a transverse, flexible membrane 55, which is made of plastic, like cap 16. A similar membrane not shown is positioned diametrically opposite membrane 55.

Figure 4:
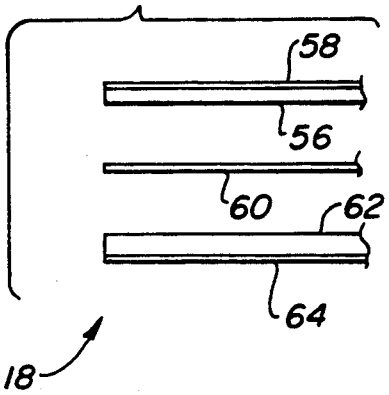
FIG. 4 is an exploded elevation view of the liner portion of FIG. 3.

As shown in FIGS. 1, 2, 3, 4, 5, 11 and 12, liner 18, which is coaxial with inner cap 16, has a relatively thin, flexible, top foil 56, which has a top adhesive coating 58 (FIG. 4). Liner ]8 also has a middle joiner strip or two-sided adhesive strip 60. Liner 18 also has a relatively thicker, bottom foil 62, (thicker than top foil 56) which has a bottom adhesive coating 64.

Figure 11:
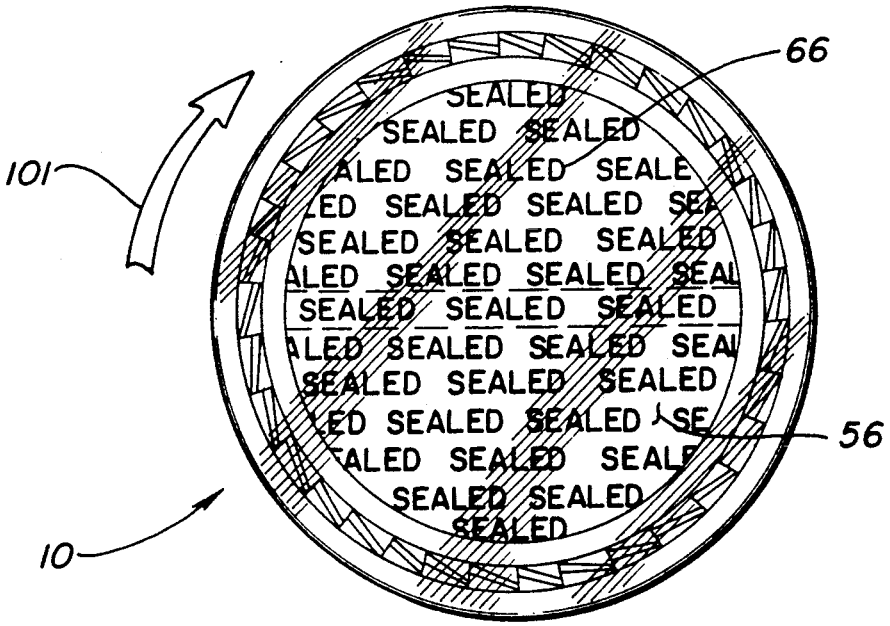
FIG. 11 is a top plan view of the closure as taken along the line 11—11 of FIG. 8.
Figure 12:
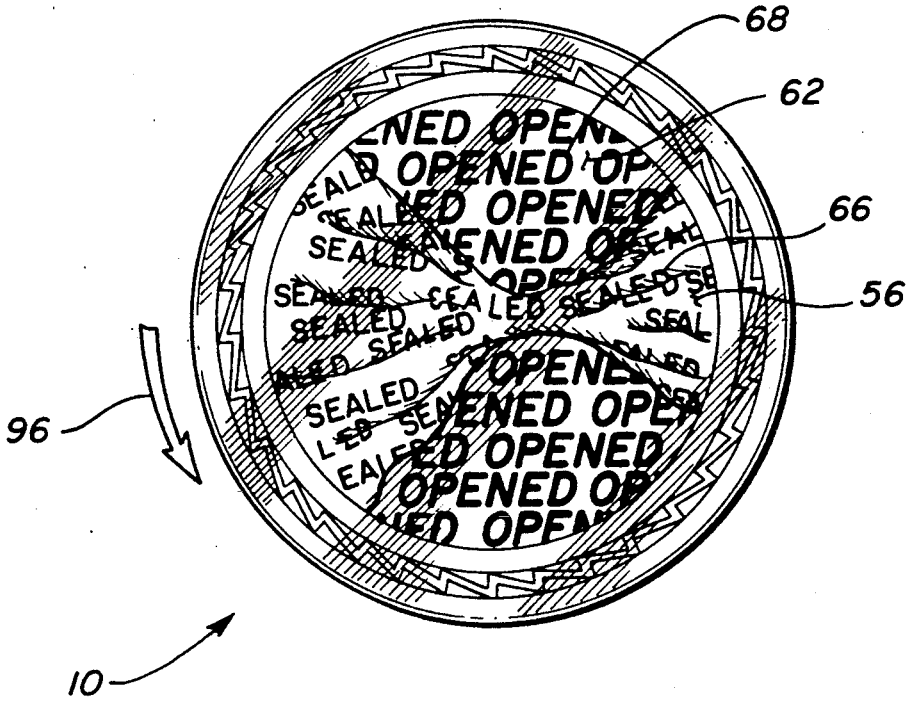
FIG. 12 is a top plan view of the closure as taken along the line 12—12 of FIG. 9.

As shown in FIGS. 11 and 12, top foil 56 typically might have repetitive, printed markings or top indicia 66, for example, "SEALED" and which are printed on its top surface. Bottom foil 62 might also have bottom indicia 68, for example, the repeating term "OPENED". Foils 56, 62 each have an outer diameter which is about equal in size to the outer diameter of end wall 34 of inner cap 16. Foils 56, 62 are made of a metal material. Bottom foil 62 and strip 60 can withstand a substantially greater torque about axis 26 than can top foil 56, so that a torque due to tampering on outer cap 20 can crinkle or tear top foil 56, without disturbing bottom foil 62 or its indicia 68. Instead of indicia foils 56 and 62 could be different colors, to signify the "sealed" conditions, for example, green and red respectively.

As shown in FIGS. 4 and 5, liner coatings 58, 64 are activated by induction waves 70 which are dispensed by a conventional induction machine 72.

As shown in FIGS. 2 and 5, outer cap 20, which is coaxial with inner cap 16 and liner 18 along axis 26, has an annular wall 74, which has a radially inner surface 76. Outer cap 20 also has a bottom circular end edge 78 and has a top end wall 80. Cap 20 is made of transparent plastic.

As shown in FIGS. 1, 2 and 5, inner surface 76 has two square protrusions or spikes 82, 84, which have respective chamferred edges 86, 88 and which are disposed 180 degrees apart and which are received normally in channel 36. As shown in FIG. 13, spikes 82, 84 are also moveable to respective channels 38, 40. As shown in FIGS. 5 and 6, inner surface 76 has a circular series of inner ratchet teeth 90 (FIG. 2), for connection to teeth 48. Inner surface 76 also has a circular lip portion 91, which is disposed adjacent to bottom edge 78. Lip 91 has an inside diameter, which is slightly smaller than the outside diameter of ridge 50, so that inner cap 16 cannot fall out of outer cap 20 after assembly thereof.

As shown in FIG. 5, a selective gap or clearance 92 is provided between the lower surface of end wall 80 and the upper surface of end wall 34, for receiving liner 18. At such clearance 92, spikes 82, 84 are disposed in bottom channel 36, and ratchet teeth 48, 90 are engaged.

As shown in FIGS. 5 and 6, torque in a clockwise direction 93 is transmitted through ratchet teeth 48, 90 from outer cap 20 to inner cap 16, for tightening closure 10 onto container 12. Caps 16 and 20 turn as an integral unit when rotated in a clockwise direction due to the cooperative engagement of the ratchet teeth.

To assemble the closure, outer cap 20 is inverted so that lip 91 is directed upward. Liner 18 is placed in the cap 20 with the top adhesive coating 58 in contact with surface 95 of end wall 80. Inner cap 16 is then force-fitted past lip 91 into the interior of outer cap 20, spikes 82 and 84 would be disposed in bottom channel 36 and ratchet teeth 48 and 90 would be engaged.

If desired, secondary liner 14 would be inserted into the interior of the inner cap and pressed into contact with surface 97 of end wall 34. In order to keep liner 14 in contact or close proximity to surface 97, as noted earlier, liner 14 can have a diameter slightly larger than the opening into the interior of cap 16; or it could be affixed by adhesive to surface 97. Once assembled, the closure 10 is passed through induction waves 70, to affix top foil 56 to surface 95 of end wall 80 by means of adhesive 58. Similarly, bottom foil 62 is affixed to top surface of end wall 34 by means of adhesive 64. After this induction sealing process, closure 10 can be threaded onto container 12.

As shown in FIG. 7, assembled closure 10 is placed over spout 24 of container 12 and is moved in a downward direction 94, so that threads 54 connect to threads 22. Spikes 82, 84 are disposed in bottom channel 36 at this stage.

As shown in FIG. 8, assembled closure 10 is rotated in a clockwise direction 101, as viewed from the top thereof, for threading closure 10 onto container 12.

As shown in FIG. 11, which is taken along line 11—11 of FIG. 8, the undisturbed top foil 56 reads "SEALED" or other similar indication at this stage. The structure of ratchet teeth 48 and 90 and the positioning of spikes 82 and 84 in bottom channel 36 ill permit the outer cap 20 to move fully and independently of inner cap 16 (which remains stationary) when an attempt is made to remove the closure 10. This is depicted in FIG. 9, with counter-clockwise movement indicated by direction 96.

As shown in FIG. 12, which is taken on line 12—12 of FIG. 9, such movement in direction 96, causes top foil 56 to shear or tear away from bottom foil 62, revealing indicia 68.

As shown in FIG. 10, spikes 82, 84 move from bottom channel 36 to top channels 38, 40, by rotation in a counterclockwise direction 98, and by concurrent axial movement due to a force in an upward direction 99, which is applied to outer cap 20. This axial force must be applied when the spikes 82, 84 are axially aligned with the two diametrically disposed membranes, one of which is membrane 55. Spikes 82, 84 move into top channels 38, 40 and eventually bear against respective stop walls 46, so that further movement in direction 98 causes closure 10 to unscrew from container 12. Thus, an easily opened closure 10 is provided for beneficial use by an adult of any age.

As shown in FIG. 13, spikes 82, 84 are fixedly connected to outer cap 20 and are normally received in channel 36. Spikes 82, 84 are each moveable through a respective vertical groove such as groove 42 (there is a second vertical groove diametrically disposed on the other side of the cap 16). Spikes 82, 84 also have respective chamferred edges 86, 88 to facilitate sliding over flexible membrane 55 and its diametrically disposed, counterpart. Each spike 82, 84 is moveable through a right angle turn into respective top channel 38, 40. Then, each spike 82, 84 is moveable through a 170 degree angle within top channels 38, 40. Each spike 82, 84 then can apply a force on its respective stop wall 46, (and counterpart), for unscrewing closure 10 from container 12.

Figure 14:
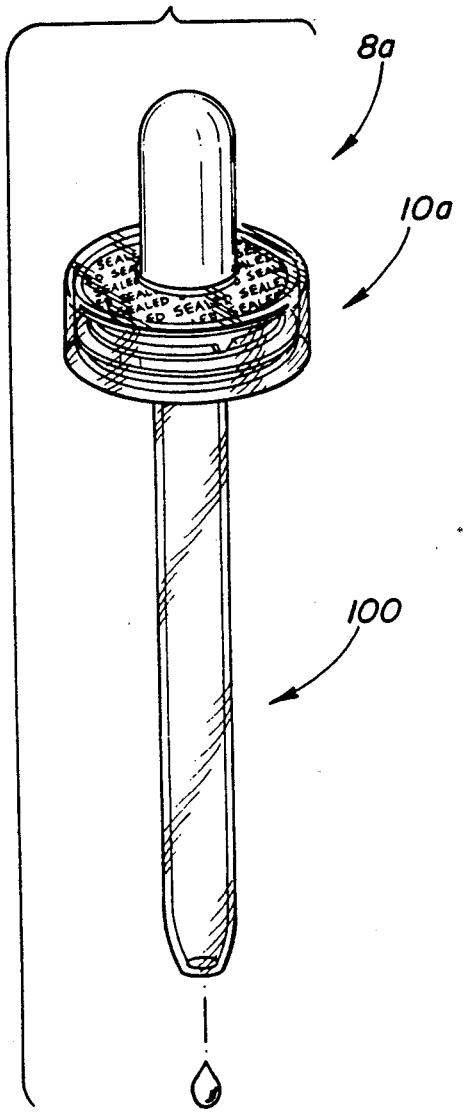
FIG. 14 is a perspective view of a second embodiment of the closure according to the invention; and, FIG. 15 is an exploded elevation view of the second embodiment of FIG. 14.
Figure 15:
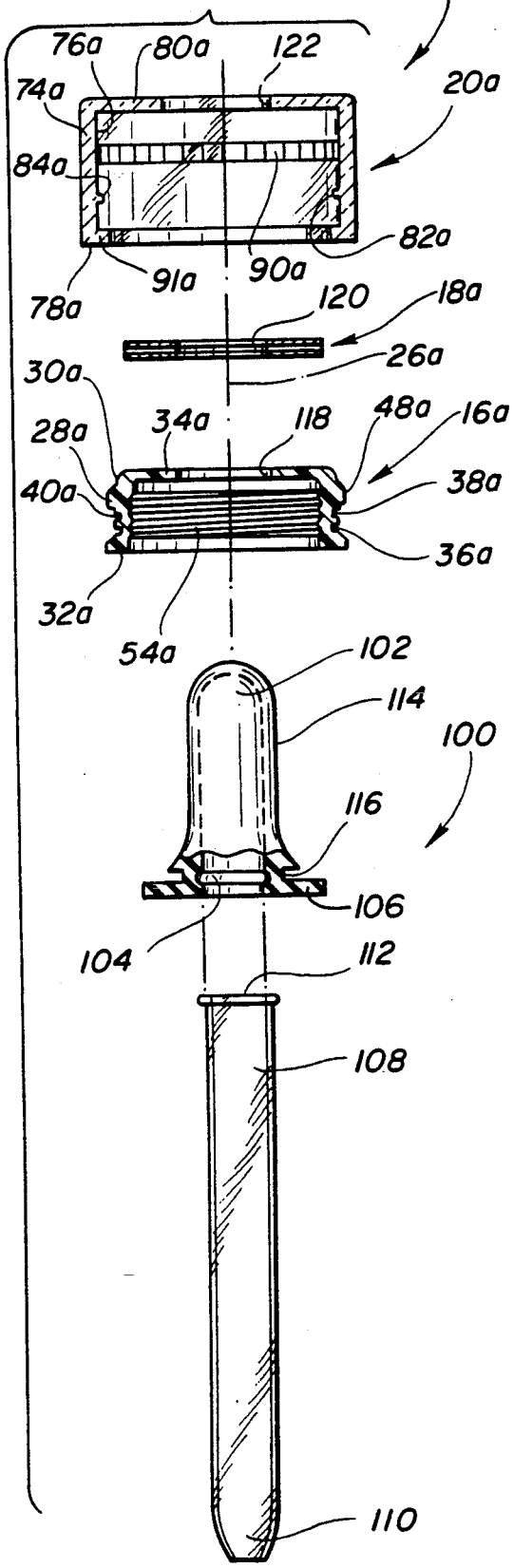

As shown in FIGS. 14 and 15, a second embodiment or assembly 8*a* is provided. Parts of second embodiment 8*a* which are the same as corresponding parts of first embodiment 8 have the same numerals, but with a subscript "a" added thereto.

Assembly 8*a* is an eye dropper. Assembly 8*a* has a closure 10*a* for a bottle (not shown) and has a liquid drop holder 100 Closure 10*a* has an inner cap 16*a*, a liner 18*a*, and an outer cap 20*a*. Drop holder 100 has a bell-shaped rubber squeezer 102, which has an annular inner groove 104 and which has an outer flange 106.

Holder 100 also has an elongate glass or plastic tube 108, which has a bottom tapered outlet portion 110 and which has a top annular outer bead or shoulder portion 112 that is received in groove 104. Squeezer 102 also has an outer surface 114, which has an outer groove 116.

Inner cap 16*a* has an axis 26*a* and has a peripheral wall 28*a* which has a radially outer surface 30*a*. Inner cap 16*a* has a bottom edge 32*a* and has a top end wall 34*a*. Inner cap 16*a* also has a bottom channel 36*a*, two top channels 38*a*, 40*a*, ratchet teeth 48*a*, internal thread 54*a*, and has an opening edge portion 118, which is received in groove 116.

Liner 18*a* has the same construction as liner 18. Liner 18*a* also has an opening edge portion 120.

Outer cap 20*a* has an annular wall 74*a*, an inner surface 76*a*, a bottom edge 78*a*, and an end wall 80*a*. Outer cap 20*a* also has two spikes 82*a*, 84*a*, ratchet teeth 90*a*, and a lip portion 91*a*. Outer cap 20*a* also has an opening edge portion 122.

Closure 10*a* is assembled by placing liner 18*a* into the inverted outer cap 20*a*. Inner cap 16*a* is assembled to the holder 100, i.e., open edge portion 118 is received in groove 116. Squeezer 102 is aligned along axis 26*a* with liner 18*a* and outer cap 20*a*. Inner cap 16*a* is press-fitted into outer cap 20*a* until spikes 82*a* and 84*a* are received in groove 36*a*. A secondary liner, not shown, but similar in purpose and construction to secondary liner 14, can be used if desired. The assembled closure is subjected to an induction heating device, so that the top and bottom foil layers of liner 18*a* are secured to the contacting surfaces of the inner and outer caps.

Closure 10*a* provides the same advantages as closure 10.

In summary, closure 10, and 10*a*, is formed through the assembly of three components, that is, inner cap 16, the tamper evident liner 18, and outer cap 20. After the two caps 16, 20 have been molded, the outer cap 20 is lined with liner 18 cut from a commercially available material. The outer and inner caps 16, 20 are then assembled to form the closure 10. After assembly, the closure 10 is subjected to high frequency energy to heat and seal the outer surfaces of the liner 18 to the inner and outer caps 16, 20. A secondary liner 14 may be inserted into the inner cap 16, to maintain seal integrity at the sealing surface of the container 12. Upon completion of these steps, the closure may be capped onto container 12 but cannot be removed without tearing the tamper evident liner 18.

Inner cap 16 is the most critical and complex part of closure 10 since it is involved in all three functions of the closure: sealing, child resistance, and tamper evidence. Inner cap 16 may be molded from a clear or opaque plastic of any desired color.

Internally, cap 16 utilizes a standard thread design but may be altered to match most thread designs required for special containers. The sealing surface of this cap allows for the insertion of sealing liner 14.

Externally, inner cap 16 utilizes a smooth, flat top which provides maximum sealing area to assure a strong bond between the lower layer of liner 18 and inner cap 16. Outer wall 28 contains protruding teeth 48, which are disposed 360 degrees around the cap 16. These teeth 48 engage teeth 90 in outer cap 20 to prevent movement during the capping operation and replacement of the closure on the container. Outer wall 28 also contains two parallel channels, 36 and 38, 40. Channel 36 which is closest to the opening edge 32, runs continuously around the closure, the other channel 38, 40 alternates, 170 degrees channel 10 degrees stop. The channels 36 and 38, 40 are interconnected by two paths or grooves 42 which allow outer cap 20 to engage and disengage the teeth 48 of inner cap 16. A thin membrane 55 must be crossed whenever changing channels.

The tamper evident liner 18 consists of two separate layers of foil 56, 62 sealed together by a longitudinal strip of adhesive 60 approximately ⅜ inch in width. The upper layer 56 of foil, printed with suitable indicia, if desired, is covered by a clear heat sealable coating 58. The lower layer 62 consists of a heavier foil, (more resistant to tear), with the top surface having any desired color or indicia printed thereon. The lower surface of the lower layer 62 is coated with a strong heat sealable coating 64 to seal the lower layer 62 to the inner cap 16. When the upper layer 56 is torn from the lower layer 62 by opening the closure, the upper surface of the lower layer 62 will be visible to the user, and signify by color and/or suitable indicia that in effect an attempt has been made to remove the closure.

Outer cap 20 is molded from a clear plastic to allow the user to see liner 18 through outer cap 20, thus providing a means of visual tamper evidence.

The advantages of closures 10 and 10*a* are indicated hereafter.

Closure 10 and 10*a* each offers the packaging industry two significant features never previously combined into a single closure, that is, child resistance, and, visual tamper evidence. Closures 10 and 10*a* each offers a simplified method of removal, yet protects against inadvertent opening by small children.

Combined with this enhanced child resistance feature, closure 10 and 10*a* each has the ability to visually inform the purchaser or user whether the container 12 had previously been opened or tampered with.

While the invention has been described in its preferred embodiment, it is to be understood that the words which have been used are words of description, rather than limitation and that changes may be made within the purview of the appended claims without departing from the true scope and spirit of the invention in its broader aspects.

The embodiments of an invention in which an exclusive property or right is claimed are defined as follows:

1. A container closure, for closing an opening of a container and for resisting child opening thereof and for recording an act of tampering therewith, comprising:

an outer cap having a transparent end wall and having an annular wall with a pair of inner spikes and having an axis;

a liner for sensing and recording an act of tampering disposed coaxially with the outer cap;

an inner cap disposed coaxially with the liner and outer cap and having a peripheral wall with spike-receiving peripheral and axial groove portions and with inner container-engaging threads.

2. The closure of claim 1, including a container having a spout portion with outer threads for engaging the inner threads.

3. The closure of claim 1, including a secondary liner member coaxially disposed interiorly of the inner cap for coacting with the container opening for sealing the container.

4. The closure of claim 1, wherein the inner cap has a bottom circular end edge and has a top end wall; and the peripheral wall has a radially outer surface; and, the peripheral groove portions are disposed in the radially outer surface and include a bottom, 360 degree channel and first and second top, about 170 degree, channels; and the axial groove portions are disposed in the radially outer surface and include a first and second vertical channel each connecting the bottom 360 degree channel to a respective, about 170 degree, channel; and each of said, about 170 degree, channels having a stop wall at an end thereof, said stop walls being disposed about 180 degrees apart; and said first and second vertical channels disposed about 180 degrees apart.

5. The closure of claim 1, wherein the liner comprises:

a relatively thin and flexible top foil;

a top adhesive coating disposed on top of the top foil for bonding to the outer cap;

a middle two-sided adhesive strip attached to the top foil;

a bottom foil, characterized in that it is more resistant to tear than said top foil, attached to the middle strip;

a bottom adhesive coating disposed on a bottom of the bottom foil for bonding to the inner cap.

6. The closure of claim 5, wherein the top foil has indicia marked on a top surface thereof for indicating to the user that the product integrity is intact; and the bottom foil has indicia marked on a top surface thereof for indicating to the user, when exposed, that the product integrity has been tampered with.

7. The closure of claim 4, wherein the outer cap has a bottom circular end edge; and the annular wall has a radially inner surface; and the pair of inner spikes are disposed about 180 degrees apart and protrude radially inward from the inner surface.

8. The closure of claim 7, wherein a radially outer surface has a circular series of ratchet teeth; and the radially inner surface has a corresponding circular series of ratchet teeth, for interconnecting the inner cap to the outer cap at a selected relative axial position thereof.

* * * * *